US006615934B2

(12) United States Patent
Mensa-Wilmot

(10) Patent No.: US 6,615,934 B2
(45) Date of Patent: Sep. 9, 2003

(54) PDC DRILL BIT HAVING CUTTING STRUCTURE ADAPTED TO IMPROVE HIGH SPEED DRILLING PERFORMANCE

(75) Inventor: Graham Mensa-Wilmot, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/930,382

(22) Filed: Aug. 15, 2001

(65) Prior Publication Data

US 2003/0034180 A1 Feb. 20, 2003

(51) Int. Cl.[7] ..... E21B 10/46
(52) U.S. Cl. ..... 175/327; 175/431
(58) Field of Search ..... 175/327, 374, 175/431, 426

(56) References Cited

U.S. PATENT DOCUMENTS

| | | | | | |
|---|---|---|---|---|---|
| 5,549,171 | A | * | 8/1996 | Mensa-Wilmot et al. | 175/431 |
| 5,678,644 | A | * | 10/1997 | Fielder | 175/391 |
| 5,937,958 | A | * | 8/1999 | Mensa-Wilmot et al. | 175/398 |
| 5,960,896 | A | * | 10/1999 | Barr et al. | 175/431 |
| 6,123,161 | A | * | 9/2000 | Taylor | 175/397 |
| 6,164,394 | A | * | 12/2000 | Mensa-Wilmot et al. | 175/331 |
| 6,308,790 | B1 | * | 10/2001 | Mensa-Wilmot et al. | 175/73 |
| 6,427,792 | B1 | * | 8/2002 | Roberts et al. | 175/431 |
| 2001/0030065 | A1 | * | 10/2001 | Beuershausen et al. | 175/327 |
| 2001/0040053 | A1 | * | 11/2001 | Beuershausen | 175/57 |
| 2002/0066601 | A1 | * | 6/2002 | Meiners et al. | 175/431 |
| 2002/0092378 | A1 | * | 7/2002 | Fielder et al. | 76/108.2 |
| 2002/0104688 | A1 | * | 8/2002 | Hoffmaster et al. | 175/385 |

FOREIGN PATENT DOCUMENTS

| | | | | | |
|---|---|---|---|---|---|
| EP | 0 556 648 | A | * | 6/1997 | E21B/10/46 |
| EP | 1 091 083 | A | * | 4/2001 | E21B/10/26 |
| GB | 2 294 712 | A | * | 5/1996 | E21B/10/46 |
| GB | 2 367 312 | A | * | 4/2002 | E21B/10/42 |
| GB | 2 370 592 | A | * | 7/2002 | E21B/10/46 |

* cited by examiner

*Primary Examiner*—William Neuder
(74) *Attorney, Agent, or Firm*—Rosenthal & Osha L.L.P.

(57) ABSTRACT

A drill bit is disclosed which includes a bit body having a plurality of blades thereon. The blades have a plurality of cutting elements affixed thereon at selected positions. The cutting elements are disposed into at least two groups. A first one of the groups has at least 60 percent of the cutting elements therein disposed at a first mean backrake angle. A second group has at least 60 percent of the cutting elements therein disposed at a second mean backrake angle. The second backrake angle is at least about fifteen degrees more than the first backrake angle. A bottom hole coverage of the cutting elements in the second group is at least about eighty percent.

28 Claims, 3 Drawing Sheets

PDC DRILL BIT HAVING CUTTING STRUCTURE ADAPTED TO IMPROVE HIGH SPEED DRILLING PERFORMANCE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of polycrystalline diamond compact (PDC) insert drill bits used to drill wellbores through earth formations. More specifically, the invention relates to selected arrangements of PDC cutting elements on such drill bits to improve drilling performance.

2. Background Art

Polycrystalline diamond compact (PDC) insert drill bits are used to drill wellbores through earth formations. PDC bits generally include a bit body made from steel or matrix metal. The bit body has blades or similar structures in it to which are attached a plurality of PDC cutting elements in a selected arrangement. The way in which the blades are structured, and the way in which the PDC cutting elements are arranged on the blades depend on, among other factors, the type of earth formations to be drilled with the particular PDC bit and the structure of a drilling assembly (known as a bottom hole assembly—"BHA") to which the drill bit is attached.

One feature of the arrangement of the cutting elements is known as the "backrake" angle. This is an angle subtended between the plane of the cutting face (diamond table) of the PDC cutting element and a line parallel to the longitudinal axis of the drill bit, or perpendicular to the profile of the bit. Typically, PDC drill bits are designed so that the cutting elements have a relatively low backrake angle. Low backrake angle provides the drill bit with relatively high performance, by reducing the weight on bit (WOB) required to fail a given earth formation, meaning that rates of penetration through earth formations are high. However, low backrake angle increases the risk that the cutting elements will be subjected to impact damage, which normally appears as chipping or fracturing of the diamond table on the cutting elements, having the cutting elements break off the bit body, or otherwise prematurely and catastrophically fail. Another feature of low backrake angle is that wear flats which ultimately form on the cutting elements have a very large areal extent across the cutting element.

Several types of PDC bits known in the art include different backrake angles on the same bit in attempts to reduce cutting element wear and damage, while maintaining the relatively good performance provided by low backrake angle. One type of PDC bit known in the art includes cutting elements having backrake angle that increases with respect to the lateral or radial position of each cutting element with respect to the longitudinal axis of the bit. Typically, such bits have the cutting elements segregated into at least two groups of cutting elements. The first such group is located laterally inward, approximately from the longitudinal (bit) axis to a first selected radial extent. Cutting elements in the first group typically have a relatively low backrake angle, because these cutting elements are closer to the axis of the bit and as a result have smaller moment arms and do not create high torque. A second group of cutting elements starts at the radial limit of the first group and extends to the gage radius of the bit. Cutting elements in the second group have a higher backrake angle than those in the first group, because their moment arms are bigger. At higher backrake angles, the elements in this second group will have lower resulting forces, which helps to reduce the torque they will have created due to their bigger moment arms. Still other bits having this general arrangement of PDC cutting elements include a third group of cutting elements having higher backrake angle than the second group. The third group of cutting elements starts at a radial limit of the second group and continues out to the gage radius of the bit. Generally speaking, this type of PDC bit has increasing cutting element backrake angle as the radial distance of the cutting element increases. Increased backrake angle is usable because they make the cutting elements comparatively more passive, and thus less susceptible to impact damage in events of vibration behavior.

Low backrake angles in general improve the penetration rates of PDC bits. However, low backrake angles also reduce the amount of useable diamond on a PDC cutting element, and thus the bit's life or durability. High backrake angles reduce rates of penetration, but cutting elements in such configurations are less susceptible to impact damage and present more useable diamond and thus improve bit life.

Another type of PDC bit known in the art includes PDC cutting elements having a first backrake angle on selected blades, and PDC cutting elements having a second backrake angle on other selected blades. Typically the selected backrake angle will alternate between successive blades.

The backrake arrangements known in the art, however, have not proven to be very suitable for use with high speed drilling tools and/or assemblies. Such drilling tools or assemblies, as known in the art, include "turbines" hydraulic motors, and sometimes high rotary speed assemblies. What is needed, therefore, is a drill bit having cutting elements arranged to improve performance when used with high speed tools or drilling assemblies, especially turbines What is also needed is a bit which combines the increased life characteristics of high backrake angle with the increased rates of penetration associated with low backrake angle.

SUMMARY OF THE INVENTION

One aspect of the invention is a drill bit which includes a bit body having a plurality of blades thereon. The blades have a plurality of cutting elements affixed to them at selected positions. The cutting elements are disposed into at least two groups. A first one of the groups has at least 60 percent of its cutting elements disposed at a first mean backrake angle. A second group has at least 60 percent of its cutting elements disposed at a second mean backrake angle. The second mean backrake angle is at least about fifteen degrees more than the first mean backrake angle. The bottom hole coverage of the cutting elements in the second group is at least about eighty percent.

In some embodiments, each cutting element on the bit has a unique radial position with respect to the bit geometric axis. In some embodiments, the cutting elements in the second group have a higher abrasion resistance than the cutting elements in the first group. In some embodiments, each of the cutting elements has a backrake angle which is related to the radial distance of the cutting element from the bit axis.

In some embodiments, at least one cutting element is disposed at substantially the same radial position as a corresponding cutting element in either the first group or the second group. In some embodiments, the at least one cutting element has the same backrake angle as the corresponding cutting element. In some embodiments, the at least one cutting element is a different diameter than the corresponding cutting element. In some embodiments, at least one of the blades on the bit body has at least one cutting element from the first group and from the second group, and has at least one alternation of backrake angle thereon.

Other aspects and advantages of the invention will be apparent from the following description and the appended claims.

DETAILED DESCRIPTION

Figure 1A:
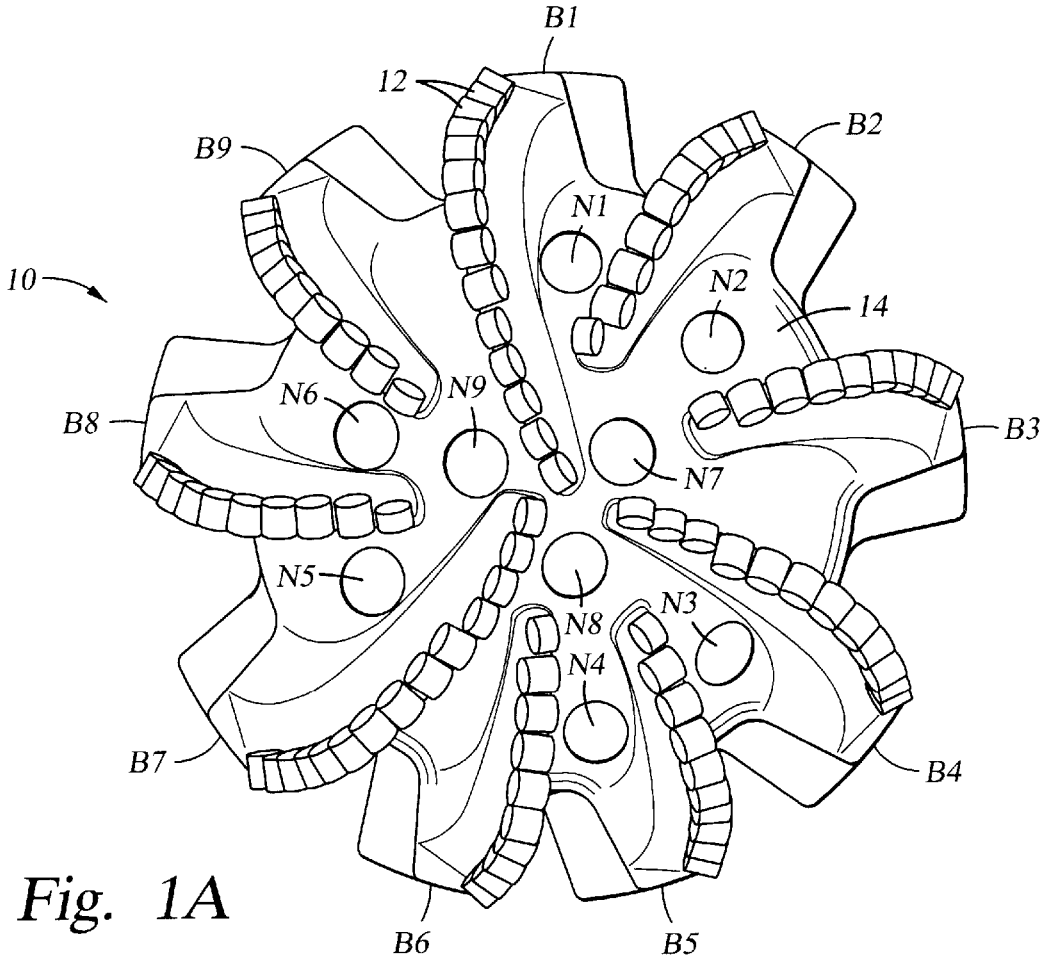
FIG. 1A shows an end view of one embodiment of a bit according to the invention.
Figure 2:
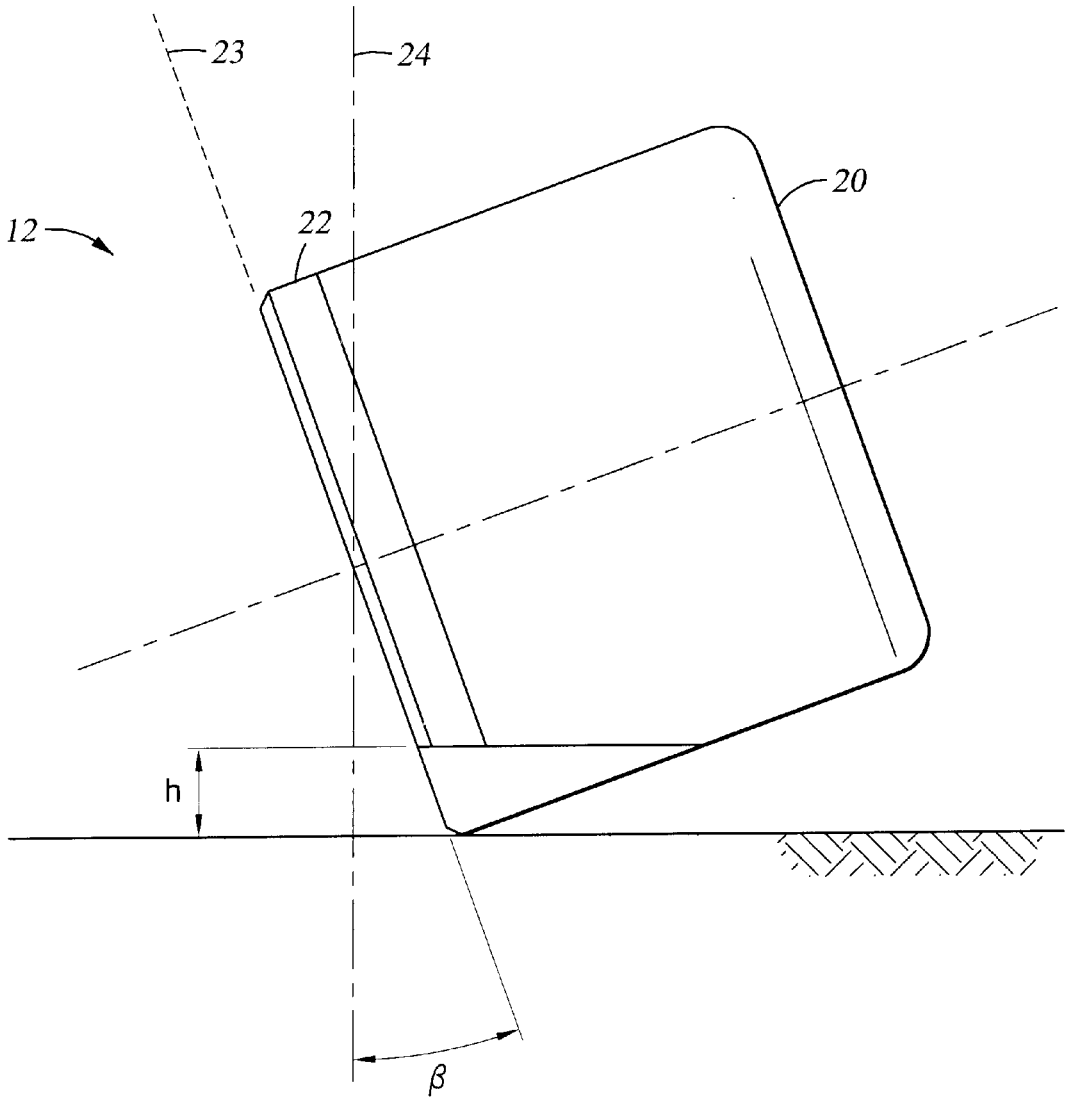
FIG. 2 shows a side view of a cutting element to illustrate backrake angle and typical construction of a PDC cutting element.

One embodiment of a drill bit according to the invention is shown in an end view in FIG. 1A. The view in FIG. 1A is of the cutting end of the bit 10. The bit 10 includes a body 14 which may be made from steel, or a matrix material of any type known in the art for the formation of fixed cutter bit bodies. The bit body 14 has formed therein an arrangement of blades B1 through B9. The blades B1–B9 form attachment surfaces, to which are affixed a plurality of cutting elements 12, which in this embodiment are polycrystalline diamond compact (PDC) inserts. While the cutting elements in the example bit of FIG. 1A are PDC inserts, it should be clearly understood that other types of cutting elements used in fixed-cutter bits, such as cubic boron nitride, or other super hard material, or hard material such as metal carbide, may also be used in a bit made according to the invention. The bit 10 typically includes a plurality of drilling fluid discharge orifices, called nozzles or jets, shown generally at N1 through N8 in FIG. 1A. The cutting elements 12 are arranged on the blades B1–B9 so that the bit 10 has desired drilling characteristics, for example, a particular type of formation most suited to be drilled by the particular bit. This example is not intended to limit the factors affecting any design of a bit according to the invention, however. Typically, the cutting elements 12 will each have a selected backrake angle. Backrake angle, as illustrated at β in FIG. 2, is defined as the angle subtended between a plane 23 of the cutting face of the diamond table 22 of the cutting element 12 and a line 24 parallel to the bit axis (not shown in FIG. 2). FIG. 2 also illustrates typical construction of a PDC cutting element 12. The cutting element 12 includes the diamond table 22, formed from sintered polycrystalline diamond, bonded to a substrate or cutter body 20. The substrate 20 is typically formed from tungsten carbide or similar material.

Figure 1B:
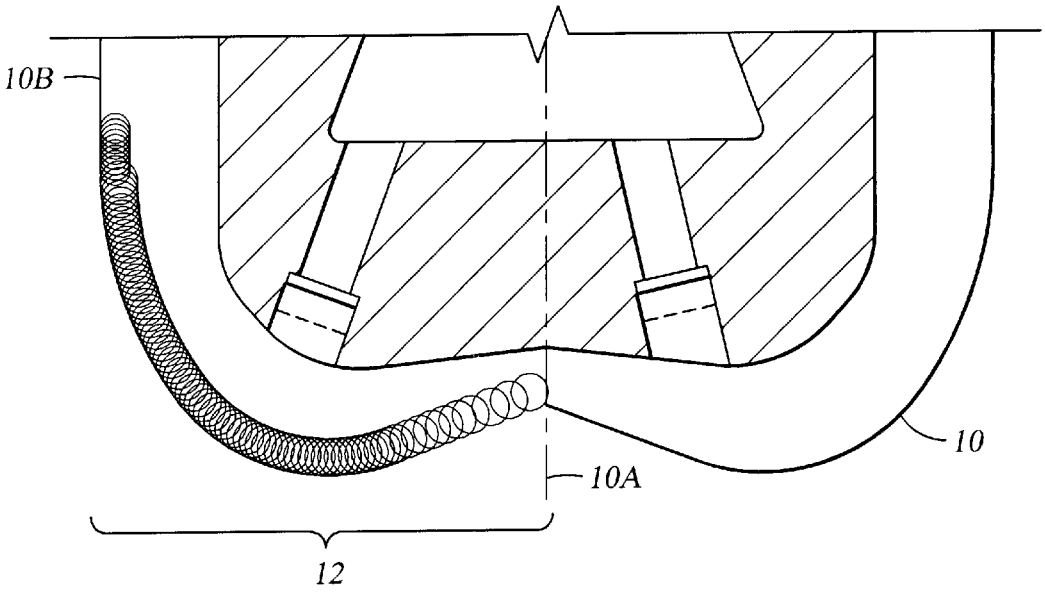
FIG. 1B shows a "profile" view of the embodiment shown in FIG. 1A.

The bit shown in FIG. 1A is known in the art as a "single set" bit. Such bits have a unique radial position, with respect to the rotational axis (not shown) of the bit, for each cutting element on the bit. The unique radial position of each cutting element on the bit of FIG. 1A is better shown in a "profile" view of the bit in FIG. 1B. The view in FIG. 1B represents each blade (B1–B9 in FIG. 1A) being rotationally projected about the longitudinal axis 10A so that it is in the same cross-sectional plane as all the other blades. Note that each cutting element 12 has a unique radial position with respect to the bit axis 10A. The profile view in FIG. 1B also indicates that the cutting elements 12 in the aggregate establish substantially "full bottom hole coverage", which can be defined as having the cutting elements arranged to "overlap" such that at least some cutting surface from the cutting elements contacts substantially the entire distance from the axis 10A to the gage radius 10B of the bit 10. Thus, when the bit is rotated, substantially the entire "bottom hole" is covered by the cutting elements.

Notably, the cutting elements 12 have substantial radial overlap when viewed in profile view. The significance of the radial overlap is that even for single set drill bits, there can exist more than one subset (called a "group" for purposes of explaining the invention) of all the cutting elements on the drill bit which may be characterized as having substantially "full coverage." The significance of having more than one full or nearly full, coverage group of cutting elements will be further explained.

In one aspect of a drill bit according to the invention, the cutting elements are arranged on the bit so that there exist at least two distinct groups of cutting elements, each of which groups has preferably a coverage of at least about 80 percent of the surface from the bit axis (10A in FIG. 1B) to the gage radius (10B in FIG. 1B) of the bit. More preferably, the cutting elements in each of the at least two groups have coverage of at least about 90 percent of the area from the axis to the gage radius, this coverage referred to as "bottom hole coverage". The at least two distinct groups of cutting elements may be placed on any combination of one or more blades (such as B1–B9 in FIG. 1A) on any particular drill bit.

In a bit according to this aspect of the invention, at least 60% of the cutting elements in the first group has a first mean backrake angle, which may be within a range of about 5 degrees of a selected mean value thereof suitable for drilling earth formations. These cutting elements in the first group may be referred to as "low backrake angle" cutting elements. In some embodiments, the backrake angle selected for the cutting elements in first group may be related to the radial position of the individual cutting elements in the first group. Such arrangements are known in the art and include, for example, an increasing backrake angle with respect to radial distance of each cutting element from the bit axis (10A in FIG. 1B).

At least 60% of the cutting elements in the second group of cutting elements have a second mean backrake angle, which may be within a range of about 5 degrees of a selected mean value thereof. The selected mean value of backrake angle for the cutting elements in the second group is at least about 15 degrees, and more preferably is at least about 25 degrees, more than the selected mean value of backrake angle for the first group of cutting elements. For purposes of explanation of the invention, these cutting elements in the second group may be referred to as "high backrake angle" cutting elements.

In any bit according to this aspect of the invention, the cutting elements in the second group must have at least 80 percent, and more preferably, at least about 90 percent bottom hole coverage. The cutting elements in the first group preferably, but not necessarily, should have at least about 80 percent, and more preferably at least about 90 percent bottom hole coverage. Some embodiments of a bit according to this aspect of the invention may include a backrake angle which is related to the radial distance of each cutting element in the second group from the bit axis (10A in FIG. 1B). Having a backrake angle related to the radial position of each cutting element in the second group would typically be combined in an embodiment of a bit according to the invention where the first group of cutting elements also includes a backrake angle related to the radial position of each of the cutting elements in the first group.

In particular embodiments of a bit made according to this aspect of the invention, the high backrake angle cutting elements may be selected to have increased resistance to abrasive wear as compared to the cutting elements in the first group. Such increased resistance to abrasive wear may include either one or both of smaller grain sizes for the polycrystalline diamond and a thicker diamond table, where the cutting elements are PDC inserts. Thicker diamond table may be defined for purposes of these embodiments as having 50 percent or more greater diamond table thickness than the low backrake angle cutting elements. In particular embodiments, the diamond table thickness of the low backrake angle cutting elements is about 0.120 inches (3.05 mm), and the diamond table thickness of the high backrake angle cutting elements is about 0.180 inches (4.57 mm). In other embodiments, cutting element sizes and/or geometries may differ within a given group or between different groups of cutting elements.

Figure 3A:
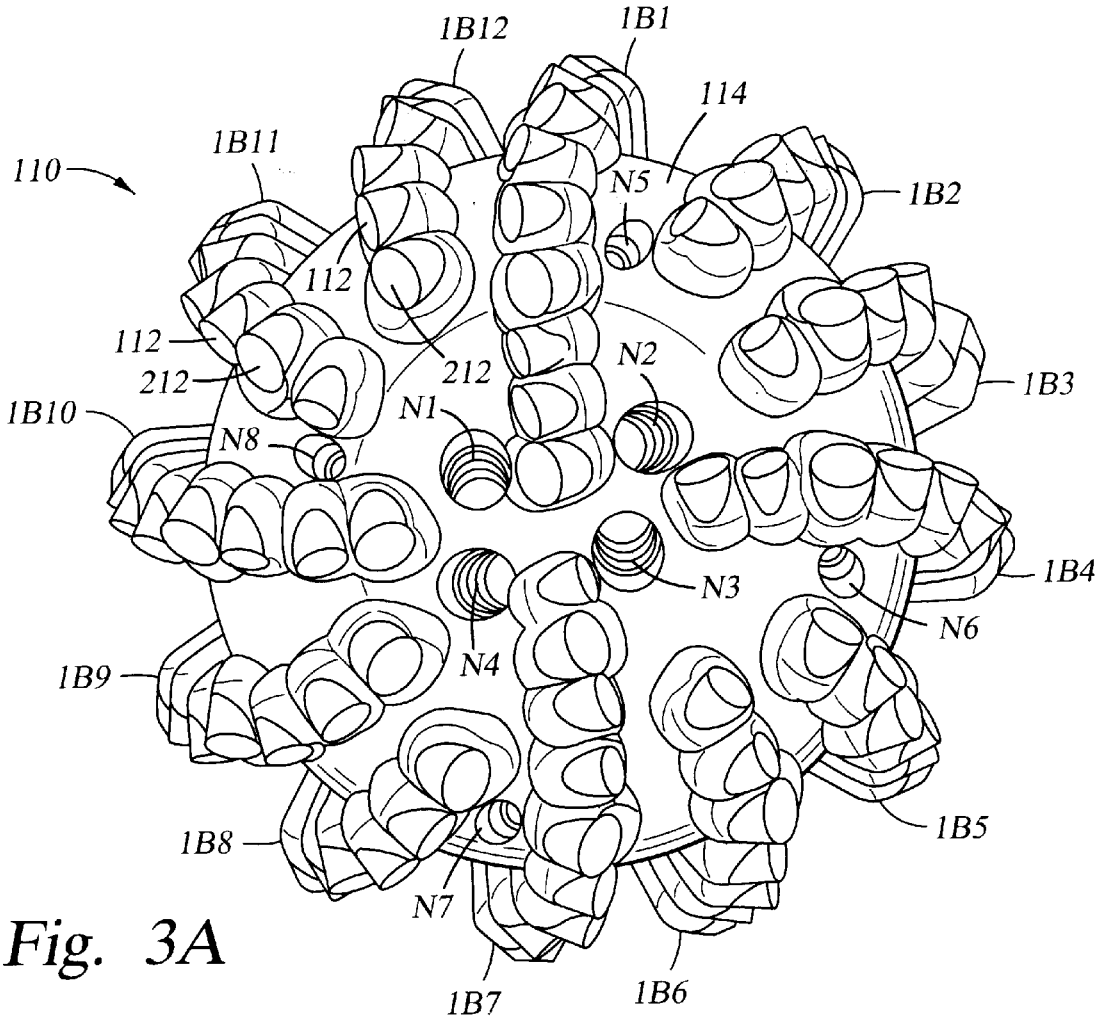
FIG. 3A shows an end view of another embodiment a bit according to the invention.

Another type of drill bit which can be made according to various aspects and embodiments of the invention is shown in end view in FIG. 3A. The bit shown in FIG. 3A is a so called "plural set" bit. The plural set bit 110 includes a bit body 114 made from steel or matrix material and having a plurality of blades 1B1 through 1B12. Cutting elements 112, 212 are arranged at selected positions on the blades 1B1–1B12.

A plural set bit includes more than one cutting element at at least approximately one radial position with respect to the bit axis. Expressed alternatively, at least one cutting element includes therefor a "backup" cutting element disposed at about the same radial position with respect to the bit axis. The radial positions of each of the cutting elements should be selected so that the cutting elements, in the aggregate, provide substantially full coverage, just as in the single set embodiments explained earlier herein. In embodiments of a plural set bit according to the invention, the cutting elements 112, 212 may include one or more "back up" cutting elements for one or more "primary" cutting elements. A back up cutting element is positioned rotationally behind a primary cutting element and has a radial position which is approximately equal to that of the primary cutting element with respect to the axis of the bit. The cutting elements shown in FIG. 3A include some having a low backrake angle, such as cutting element 112, and include some others having a high backrake angle, such as cutting element 212.

Just as in the single set embodiments of a bit according to the invention, the cutting elements in plural set embodiments are segregated into at least two groups. Each of the groups has at least 80 percent bottom hole coverage, and more preferably at least 90 percent bottom hole coverage. A first group has a first selected mean backrake angle, for at least 60% of its cutting elements, which may be within a range of about 5 degrees about the selected mean value. A second group has a second selected mean backrake angle which may be within a range of about 5 degrees about the second mean value for at least 60% of its cutters, when the second selected mean backrake angle is at least about 15 degrees, and more preferably is at least about 25 degrees more than the first selected mean back rake angle of the first group.

Figure 3B:
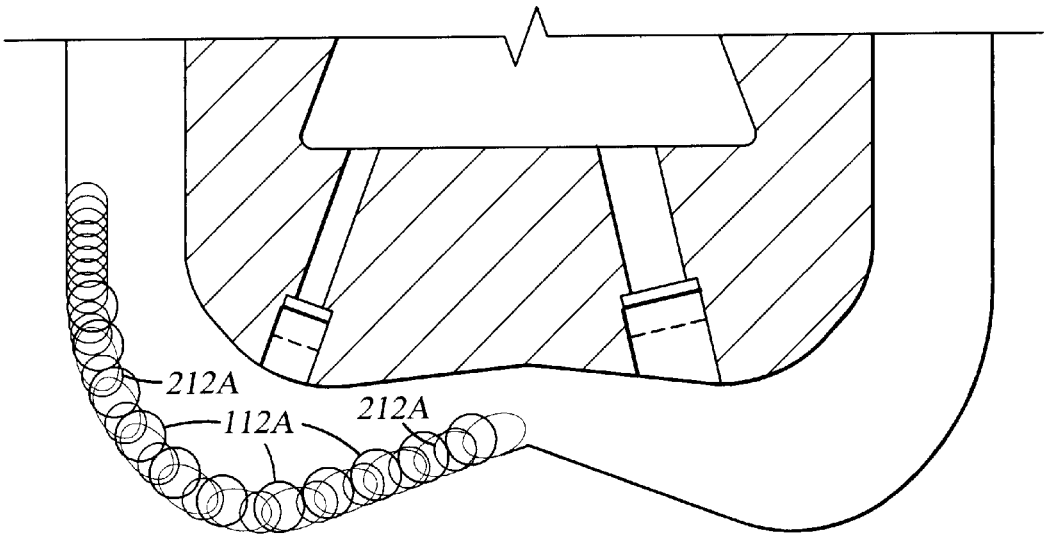
FIG. 3B shows a cutting element placement profile of the bit in FIG. 3A.

In a plural set bit according to the invention, a backup cutting element may have the same backrake angle as the corresponding primary cutting element, or may have a different backrake angle than the corresponding primary cutting element. In some embodiments of a plural set bit, a backup cutting element may be a different diameter than the corresponding primary cutting element. Alternatively, the backup cutting element may have the same diameter as the primary cutting element. A profile view of the bit of FIG. 3A is shown in FIG. 3B. The example bit of FIG. 3A is more clearly shown in FIG. 3B as having more than one cutting element diameter, for example small diameter cutting elements 212A, and larger diameter cutting elements 112A. For this embodiment, the different sized cutting elements are in different groups. In other embodiments, the backup cutting element may have a different geometry than the primary cutting element. Cutting element geometries other than right cylindrical are known in the art.

Plural set embodiments of a bit according to the invention preferably include at least one blade (1B1–1B12 in FIG. 3A) having thereon at least one cutting element having the first backrake angle (in the first group), and at least one cutting element having the second backrake angle (in the second group), and this at least one blade also has at least one alternation of backrake angle thereon. Alternation of backrake angle means that where the at least one blade has two high backrake angle cutting elements, they are disposed so as to be on radially opposed sides of one of the low backrake angle cutting elements. Conversely, where the at least one blade includes two of the low backrake angle cutting elements and at least one high backrake angle cutting element, the low backrake angle cutting elements should similarly "bracket" the high backrake angle cutting element. An additional embodiment of the alternation includes that when all the different groups of cutters are rotated onto a single radial plane, there will exist an alternation of the backrake angles along the bit's profile, similar in nature to that described for the individual blades.

As in the single set embodiments, in plural set embodiments the high backrake angle cutting elements preferably are selected to have higher abrasion resistance than the low backrake angle cutting elements. Higher abrasion resistance, as previously explained with respect to single set embodiments, may result from either or both a thicker diamond table and finer diamond grain size in the polycrystalline diamond.

A drill bit made according to various embodiments of the invention such as disclosed herein may have improved drilling performance at high rotational speeds as compared with prior art drill bits. Such high rotational speeds are typical when a drill bit is turned by a turbine, hydraulic motor, or used in high rotary speed applications.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body having a plurality of blades thereon;

the blades having a plurality of cutting elements affixed thereon at selected positions;

the cutting elements being disposed into at least two groups, a first one of the at least two groups having at least sixty percent of the cutting elements therein disposed at a first mean backrake angle, a second one of the at least two groups having at least sixty percent of the cutting elements therein disposed at a second mean backrake angle, the second mean backrake angle being at least about fifteen degrees more than the first mean backrake angle, a bottom hole coverage of the cutting elements in the second group being at least about eighty percent.

2. The drill bit as defined in claim 1 wherein a bottom hole coverage of the cutting elements in the first group is at least about eighty percent.

3. The drill bit as defined in claim 1 wherein a bottom hole coverage of the cutting elements in the second group is at least about ninety percent.

4. The drill bit as defined in claim 1 wherein the mean backrake angle of the cutting elements in the second group is at least about twenty-five degrees more than the mean backrake angle of the cutting elements in the first group.

5. The drill bit as defined in claim 1 wherein the cutting elements in the second group have a higher abrasion resistance than the cutting elements in the first group.

6. The drill bit as defined in claim 5 wherein a diamond table thickness of the cutting elements in the second group is at least about 50 percent greater than a diamond table thickness of the cutting elements in the first group.

7. The drill bit as defined in claim 5 wherein a diamond grain size of the cutting elements in the second group is smaller than a diamond grain size of the cutting elements in the first group.

8. The drill bit as defined in claim 1 wherein the backrake angle of each of the cutting elements in the first group and the second group is related to a radial position of each of the cutting elements.

9. The drill bit as defined in claim 1 wherein each cutting element on the bit has a unique radial position with respect to an axis of the bit.

10. The drill bit as defined in claim 1 wherein at least one cutting element has a radial position that is approximately equal to that of a corresponding cutting element in the first group, the corresponding cutting element being on a different blade than the at least one cutting element.

11. The drill bit as defined in claim 10 wherein the at least one cutting element has a same backrake angle as the corresponding cutting element.

12. The drill bit as defined in claim 10 wherein the at least one cutting element has a higher backrake angle than the corresponding cutting element.

13. The drill bit as defined in claim 10 wherein the at least one cutting element has a different diameter than the corresponding cutting element.

14. The drill bit as defined in claim 10 wherein at least one of the blades has thereon at least one cutting element in the first group and at least one cutting element in the second group, and the at least one of the blades has at least one alternation of backrake angle thereon.

15. The drill bit as defined in claim 10 wherein the at least one cutting element has a different geometry than the corresponding cutting element.

16. The drill bit as defined in claim 1 wherein at least one cutting element has a radial position that is approximately equal to that of a corresponding cutting element in the second group, the at least one cutting element being on a different blade than the corresponding cutting element.

17. The drill bit as defined in claim 16 wherein the at least one cutting element has a same backrake angle as the corresponding cutting element.

18. The drill bit as defined in claim 16 wherein the at least one cutting element has a higher backrake angle than the corresponding cutting element.

19. The drill bit as defined in claim 16 wherein the at least one cutting element has a different diameter than the corresponding cutting element.

20. The drill bit as defined in claim 16 wherein at least one of the blades has thereon at least one cutting element in the first group and at least one cutting element in the second group, and the at least one of the blades has at least one alternation of backrake angle thereon.

21. The drill bit as defined in claim 16 wherein the at least one cutting element has a different geometry than the corresponding cutting element.

22. The drill bit as defined in claim 1 wherein the cutting elements comprise polycrystalline diamond compact inserts.

23. The drill bit as defined in claim 1 further comprising at least one cutting element having a different diameter than other ones of the cutting elements.

24. The drill bit as defined in claim 23 wherein the at least one different diameter cutting element is in the first group.

25. The drill bit as defined in claim 23 wherein the at least one different diameter cutting element is in the second group.

26. The drill bit as defined in claim 1 further comprising at least one cutting element having a different geometry than other ones of the cutting elements.

27. The drill bit as defined in claim 26 wherein the at least one different geometry cutting element is in the first group.

28. The drill bit as defined in claim 26 wherein the at least one different geometry cutting element is in the second group.

* * * * *